US008156719B2

(12) United States Patent
Reuteler et al.

(10) Patent No.: US 8,156,719 B2
(45) **Date of Patent: *Apr. 17, 2012**

(54) PACKAGING MACHINE

(75) Inventors: Urs Reuteler, Atlanta, GA (US); Matt M. Mate, Forest Lake, MN (US); Ronald Scott Thompson, White Bear Lake, MN (US); Daniel Duane Schroeder, Stacy, MN (US); Mike Lee, Riverside, CA (US)

(73) Assignee: Delkor Systems, Inc., Circle Pines, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/970,292

(22) Filed: Dec. 16, 2010

(65) Prior Publication Data

US 2011/0083404 A1 Apr. 14, 2011

Related U.S. Application Data

(63) Continuation of application No. 12/264,070, filed on Nov. 3, 2008, now Pat. No. 7,856,798.

(51) Int. Cl.
*B65B 57/00* (2006.01)

(52) U.S. Cl. ..... 53/484; 53/285; 53/376.3; 53/377.5; 53/382.2

(58) Field of Classification Search ..... 53/476, 53/484, 488, 285, 376.3, 377.5, 377.6, 378.3, 53/383.2, 382.2
See application file for complete search history.

(56) References Cited

U.S. PATENT DOCUMENTS

| | | | | |
|---|---|---|---|---|
| 4,974,077 | A * | 11/1990 | Kusaba | 382/141 |
| 5,007,096 | A * | 4/1991 | Yoshida | 382/142 |
| 5,212,656 | A | 5/1993 | Clary et al. | |
| 5,493,104 | A * | 2/1996 | Wilson | 235/98 R |
| 5,531,852 | A | 7/1996 | Walsh et al. | |
| 5,660,262 | A | 8/1997 | Landrum et al. | |
| 5,822,208 | A * | 10/1998 | Bory | 700/108 |
| 5,941,053 | A | 8/1999 | Kotsiopoulos | |
| 5,993,367 | A * | 11/1999 | Hattori et al. | 493/12 |
| 6,323,502 | B1 * | 11/2001 | Battut | 250/559.19 |
| 6,571,539 | B2 | 6/2003 | Gendre et al. | |
| 6,935,998 | B2 * | 8/2005 | Silvestre | 493/405 |
| 7,431,147 | B2 | 10/2008 | Reuteler et al. | |
| 7,712,287 | B2 | 5/2010 | Gallimore | |
| 2002/0088206 | A1 | 7/2002 | Gendre et al. | |
| 2003/0101693 | A1 | 6/2003 | Hoe et al. | |

* cited by examiner

*Primary Examiner* — Hemant M Desai

(74) *Attorney, Agent, or Firm* — Vidas, Arrett & Steinkraus

(57) ABSTRACT

A packaging apparatus for real-time alignment of packaging surfaces can include two or more sensors for detecting the positioning of carton surfaces and a servo system. The servo system can include a servo motor and a controller. The servo system records the positioning of the carton surfaces and calculates a difference in position. The controller compares the calculated value with a predetermined value and if necessary, the servo motor turns a correction wheel to align the carton surfaces.

14 Claims, 8 Drawing Sheets

PACKAGING MACHINE

CROSS-REFERENCE TO RELATED APPLICATIONS

This application is a continuation of U.S. patent application Ser. No. 12/264,070, filed Nov. 3, 2008, now U.S. Pat. No. 7,856,798, issued on Dec. 28, 2010, the entire contents of which is incorporated herein by reference.

STATEMENT REGARDING FEDERALLY SPONSORED RESEARCH

Not Applicable

BACKGROUND OF THE INVENTION

1. Field of the Invention

In some embodiments this invention relates generally to packaging machines and methods. In particular, some embodiments relate to a packaging machine for aligning flaps on cartons.

2. Description of the Related Art

One of the most difficult tasks in assembling a blank into a carton is that of properly aligning the top lid of the carton with the carton's body. The top lid is oftentimes skewed relative to the carton's body. Before the lid can be pressed against and sealed to the body with adhesive, it is necessary to align the lid with the body. Failure to properly align the two results in adhesive smearing along the carton.

It is important to note that most cartons today are not simply made of plain brown cardboard material. Rather, the cartons are often designed to be glossy, colorful, and full of images. The blanks are usually designed to be folded into cartons that are aesthetically pleasing, thereby creating a positive mental impression for the consumer with respect to the product, the company, or both. The carton is as much a part of the product advertising as any other aspect of an advertising campaign. Any smearing of the adhesive creates an aesthetically displeasing carton appearance that may negatively affect the product's image in the mind of the consumer.

Current methods of aligning the top lid with the carton's body use mechanical means that suffer from one or more of the following disadvantages: the mechanical means are too rigid to correct for variability, are too complicated due to high speed intermittent motion, or require too much operator adjustment. For example, U.S. Pat. No. 7,431,147, the entire contents of which is incorporated herein by reference, describes a machine for closing flaps that uses mechanical lugs. Other methods, such as described in U.S. Pat. No. 5,660,262, the entire contents of which is incorporated herein by reference, describes a machine that uses multiple belts to align cartons, using manual speed corrections.

For the foregoing reasons, there is a need for a packaging machine that intelligently positions the top flap of a carton prior to gluing onto the face of the carton.

The art referred to or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

All U.S. patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. §1.72.

BRIEF SUMMARY OF THE INVENTION

In at least one embodiment of the invention, a packaging apparatus for real-time alignment of packaging surfaces comprises a first sensor and a second sensor, wherein the first sensor outputs a position of a first packaging surface, and wherein the second sensor outputs a position of a second packaging surface. The packaging apparatus further comprises a servo system comprising a servo motor and at least one input, the at least one input being in electrical communication with the first sensor and the second sensor. When the first sensor outputs the position of the first packaging surface, the servo system records the position of the first packaging surface, and when the second sensor outputs the position of the second packaging surface, the servo system records the position of the second packaging surface. The servo system further comprises a controller for calculating the distance between the position of the first packaging surface and the second packaging surface and comparing the calculated distance against a predetermined value. The servo motor always turns in the same direction, however depending on whether the calculated distance is greater than or less than the predetermined value, the speed of the servo motor will increase or decrease accordingly. The packaging apparatus further comprises at least one correction wheel in engagement with a shaft, the shaft being in rotatable engagement with the servo motor. The packaging apparatus further comprises a nip roller being positioned adjacent the at least one correction wheel.

These and other embodiments which characterize the invention are pointed out with particularity in the claims annexed hereto and forming a part hereof However, for further understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE SEVERAL VIEWS OF THE DRAWING(S)

A detailed description of the invention is hereafter described with specific reference being made to the drawings.

FIG. 1*a* is a carton with a misaligned top with respect to its body.

FIG. 1*b* is the carton of FIG. 1*a* having it's top aligned with its body using the technique of this disclosure.

DETAILED DESCRIPTION OF THE INVENTION

Figure 1:
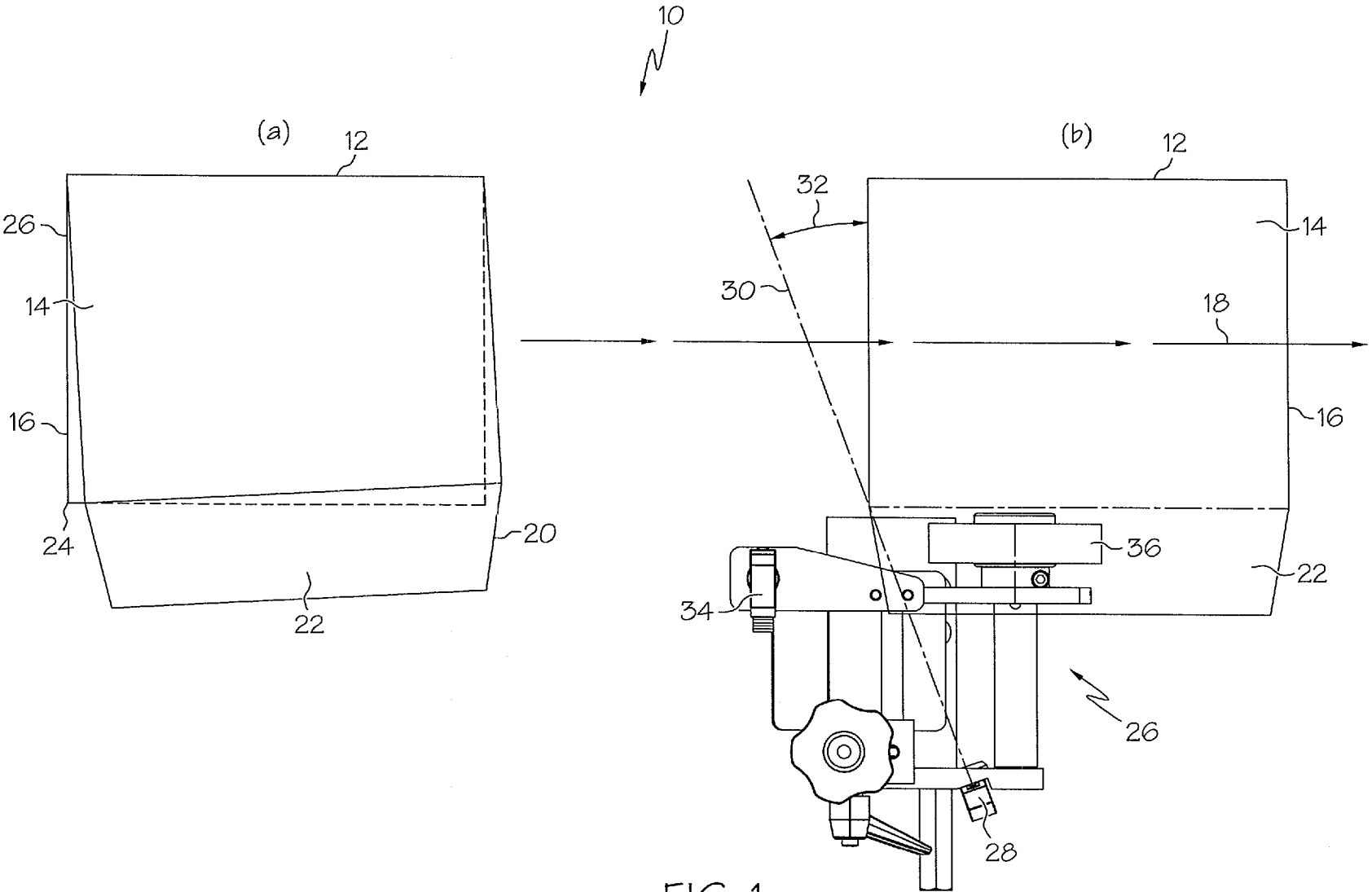

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Described in general here and in more detail below, in one embodiment of the inventive package assembly 10, as a carton 12 with a top 14 and body 16 moves to the right in FIG. 1 along path 18, at least two sensors are triggered. The triggers signal to the servo system when to read and record its position. Upon receiving a trigger, the servo system records the position of the leading edge 20 of the tuck flap 22 and the position of the rear corner 24. The difference between the two positions is determined, and then, based on a predetermined value, a correction is applied, if necessary, by a servo system 26.

Servo systems are well known by those of ordinary skill in the art and as such will not be described in detail here. However, generally speaking, a servo system may include a servo motor, a controller, and an amplifier. In at least one embodiment of the present invention, a closed loop servo system is used. In a closed loop servo system, the position of the servo system is known at all times. When a first input is received, the first input can be associated with a position value. Then, when a second input is received, the second input can be associated with another known position value. The difference between these two position values can be used to calculate an overall difference in distance. This overall difference in distance can then be used to make a relative correction based on what a known correctly aligned carton would record in position difference.

It should be noted that although the figures and description refer specifically to measuring between the position of the leading edge of the tuck flap and the position of the rear corner, some embodiments of the invention measure between the front corner of the carton and the trailing edge of the tuck flap. Furthermore, a person of ordinary skill in the art will recognize that other dimensions of the carton can be measured and compared against a known "correct" value, without detailing all of the possible combinations herein.

The target position distance between tuck flap leading edge and the rear corner of a correctly aligned carton can be as accurate as the servo system and sensor accuracy allow.

It should be noted that alignment is carton specific. That is, a correctly aligned 6 inch×6 inch×6 inch carton may have a different distance between tuck flap leading edge and the rear corner than a correctly aligned 8 inch×8 inch×4 inch carton. Production runs of differently sized cartons require that the servo system use the correct tuck flap leading edge to rear corner distance specific to that carton.

Referring again to FIG. 1, a carton 12 is shown in (a) having a top 14 that is misaligned with the body 16. The top 14 needs to be adjusted leftward in order for the top and body to be properly aligned. In (b), the carton 12 has been adjusted to correct the alignment. At least two sensors are used to detect the presence of at least two packaging surfaces—the top 14 and the body 16 of the carton. The carton detection sensor 28 is aligned such that its field of vision 30 is directed in a horizontal direction. Also, its field of vision is at an angle 32 in order to detect the rear corner 24 of the trailing edge 16 of the carton body. As shown in FIG. 1, this trailing edge is the side of the carton. The flap detection sensor 34 is aligned such that its field of vision is directed downward in order to detect the leading edge 20 of the top of the carton, and specifically, the tuck flap 22 of the carton.

In some embodiments, the sensors are optical sensors. A person of ordinary skill in the art will recognize that other sensors may also be used in embodiments of the present invention.

As mentioned above, each "correctly" aligned carton, such as the carton shown in FIG. 1(*b*), has a target horizontal distance from its tuck flap leading edge 20 to its rear corner 24. In the carton depicted in FIG. 1(*a*), the tuck flap 22 is skewed to the right, and as such, there is a greater horizontal distance between the leading edge of the tuck flap and the rear corner then in a correctly aligned carton. Similarly, in a carton having a tuck flap skewed to the left (not shown), there is a smaller horizontal distance between the leading edge of the tuck flap and the rear corner then in a correctly aligned carton.

Referring still to FIGS. 1(*a*) and (*b*), as the carton 12 moves in the direction 18 along the conveyor belt (not shown), the leading edge 20 of the tuck flap triggers the flap detection sensor 34. The position of the tuck flap is then recorded by the servo system 26. When the rear corner 24 is detected by the carton detection sensor 28, the position of the rear corner is recorded by the servo system. A controller (not shown) of the servo system 26 subtracts the two position values, and based on a predetermined range for a target "correct" distance for that type of carton, the controller decides whether the tuck flap is misaligned. Based on the tuck flap misalignment shown in FIG. 1(*a*), the controller would have calculated a distance greater than the correct distance. So, for example, if the correct predetermined distance is 8 inches and the controller calculated that the distance is 8.5 inches, the controller calculates that there is a 0.5 inch misalignment and that correction is needed. In order to correct for a misalignment, as in FIG. 1(*a*), the controller sends a signal, amplified by an amplifier, directing the servo motor to turn a sufficient amount to correct the alignment.

In addition to what was described above, the packaging apparatus further includes one or more correction wheels 36 to correct any misalignment. At least one of the correction wheels 36 is engaged to a shaft 38 that is rotatably engaged, or otherwise in operative communication with, the servo motor 40 such that operation of the servo motor results in the shaft and correction wheel turning.

Figure 2:
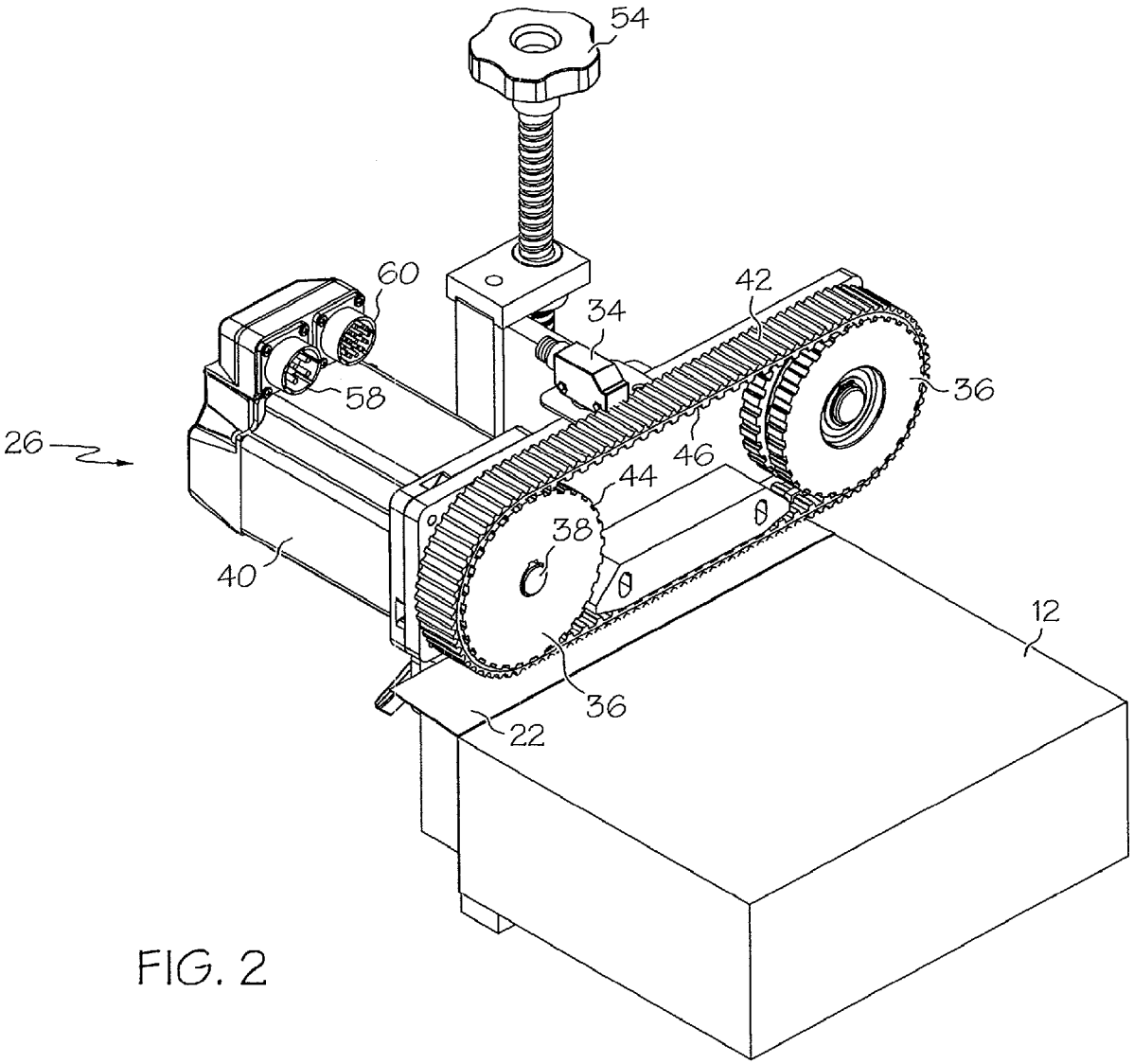
FIG. 2 is a front perspective view of an embodiment of the invention.

As seen in FIG. 2, the packaging apparatus can further include a correction belt 42 disposed about at least a portion of the correction wheel. In some embodiments, the correction wheel 36 can include grooves or indents 44, and the belt can include teeth or notches 46 that are designed to mate with the grooves on the wheel, thereby preventing any slippage between the wheel and belt.

The correction belt is generally synchronized with the conveyor belt such that the correction belt follows the conveyor belt. That is, absent the servo motor directing the correction wheel to turn a certain amount, there is no relative motion between the correction belt and the conveyor belt. There is no relative difference between the belt speeds. Thus, when the controller directs the correction belt to move 0.5 inches, it is 0.5 inches relative to the conveyor belt.

Similarly, in embodiments that use a correction wheel without the correction belt, the correction wheel is generally synchronized with the conveyor belt such that the correction wheel follows the conveyor belt. The correction wheel rotates at a constant speed and at the same speed as the conveyor. If the tuck flap is misaligned, as in FIG. 1(*a*), the correction wheel slows down for a short period to make the correction. After the correction, the correction wheel speeds up to match the line speed. If the tuck flap is trailing the carton, the servo speeds up for a short period to make the correction.

Figure 3A:
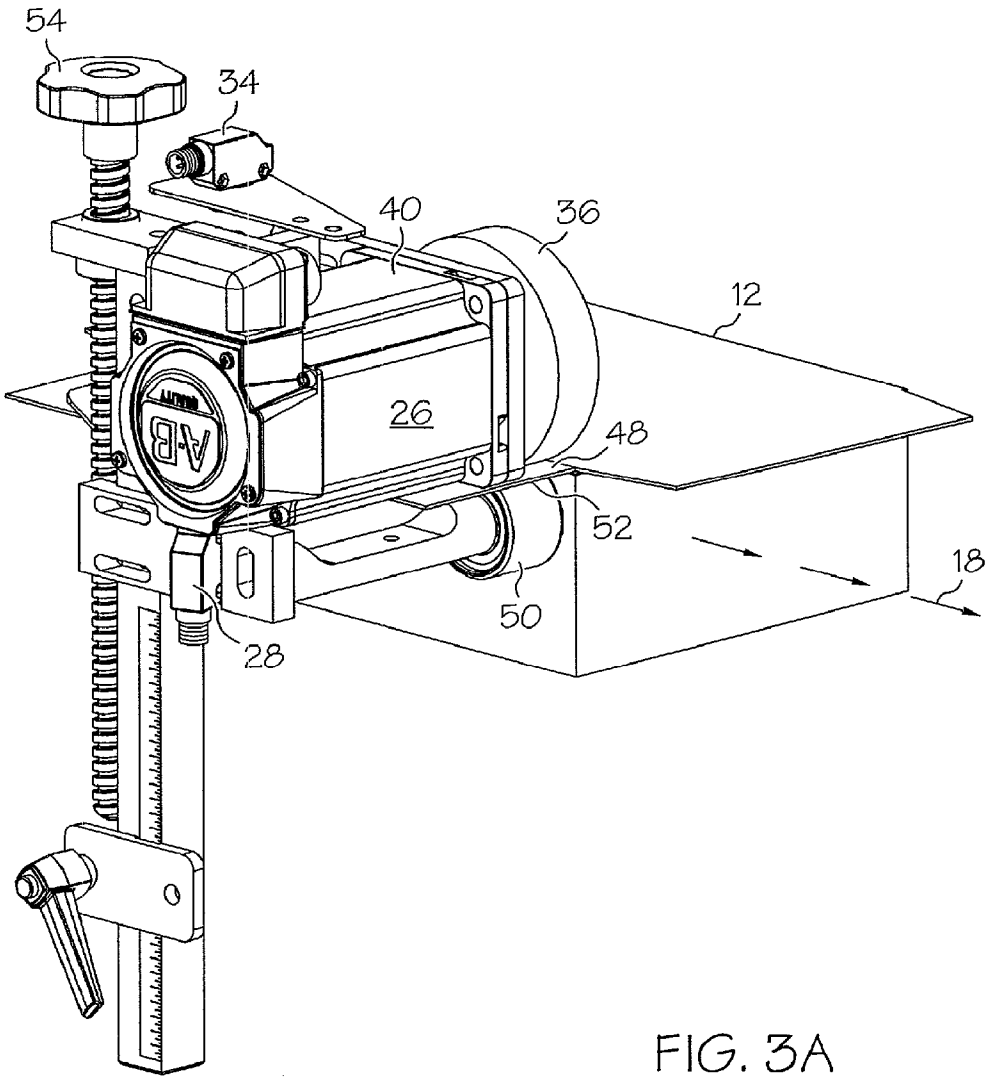
FIG. 3A is a rear perspective view of an embodiment of the invention.
Figure 3B:
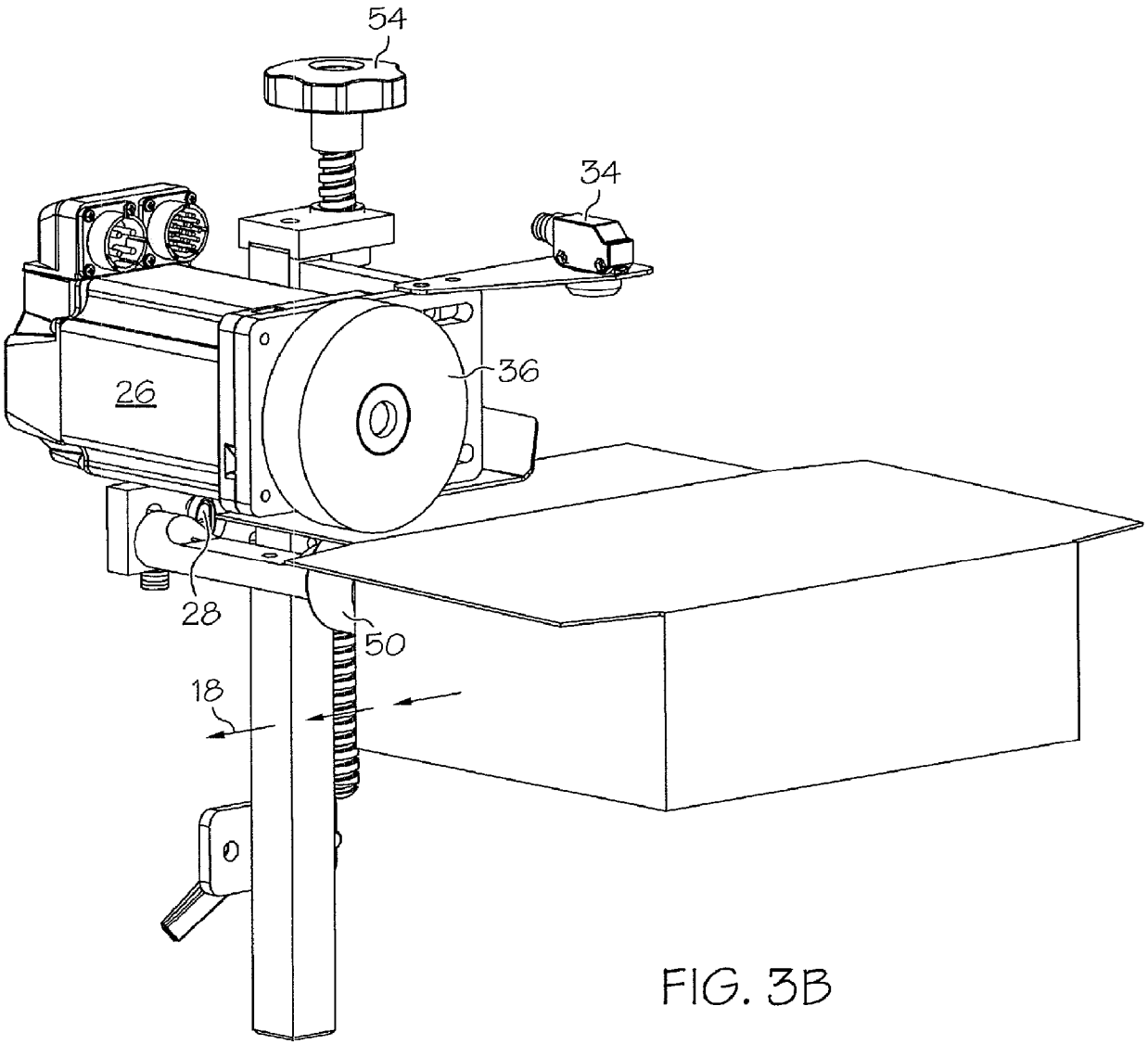
FIG. 3B is a front perspective view of the embodiment depicted in FIG. 3A.

FIG. 3A depicts the correction assembly without a correction belt. In FIG. 3A, the correction wheel 36 is designed to make contact with the top side 48 of the tuck flap. FIG. 3A depicts a nip roller 50 positioned adjacent the correction wheel that is designed to make contact with the bottom side 52 of the tuck flap. The tuck flap is gripped between the correction wheel and the nip roller. The correction wheel and the nip roller work in conjunction, allowing any rotation imparted to the correction wheel via the servo motor to shift the position of the top of the carton relative to the carton's body. The nip roller may also be used in embodiments of the present invention that utilize a correction belt. FIG. 3B depicts the servo system and sensors in more detail.

Continuing the example started above, if the carton's tuck flap is skewed to the right, as in FIG. 1(*a*), and the controller calculated a distance of 8.5 inches instead of the predetermined "correct" alignment value of 8 inches, the controller directs the servo motor to turn in one direction such that the correction belt moves 0.5 inches, thereby moving the tuck flap to the left.

If instead the tuck flap was skewed to the left, the controller would calculate a distance less than the predetermined range of alignment values, for example 7.5 inches. The controller would then direct the servo motor to turn in an opposite direction to that described above so that the correction belt moves 0.5 inches in the other direction, thereby moving the tuck flap to the right.

It should be noted that some embodiments of the present invention are designed to be used with tri-seal cartons. Additionally, the cartons can be sealed with a number of adhesives, including hot melt adhesives, temporary bond adhesives, etc. such as described in U.S. Pat. No. 7,392,905, the entire contents of which being expressly incorporated herein by reference.

Referring again to FIGS. 1-3, it should be noted that embodiments of the present invention simplify the transition between different cartons during various production runs. A height adjustment screw 54 accommodates cartons with different heights. And, the carton detection sensor and the flap detection sensor can be easily adjusted to allow for cartons of various depths, etc.

Figure 4:
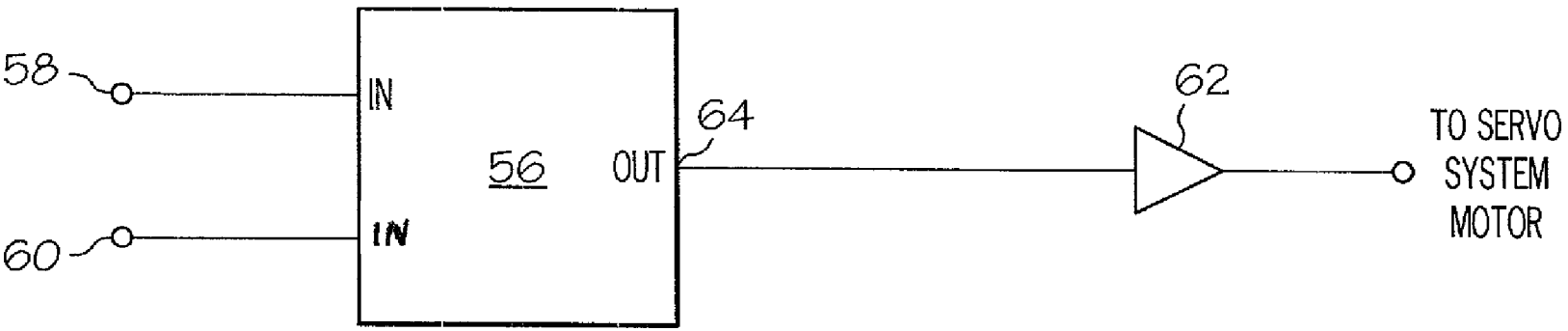
FIG. 4 is a schematic diagram of an embodiment of a controller.

As mentioned above, the servo system 26 can include a controller 56, as seen in FIG. 4. The controller 56 is in electrical communication with the servo inputs 58, 60. The controller is designed to receive the servo inputs, perform calculations, and output a signal. Such a controller can also include volatile or non-volatile memory, for example, to allow storage of variables such as carton dimensions, sensor position height and other positioning measurements, and correction wheel dimensions that may be necessary to make such exacting calculations.

Still referring to FIG. 4, the servo system can also include one or more servo amplifiers 62. The controller's output 64 can be in communication with the servo system's amplifier input such that controller output signals are amplified before being sent to the servo motor.

Figure 5:
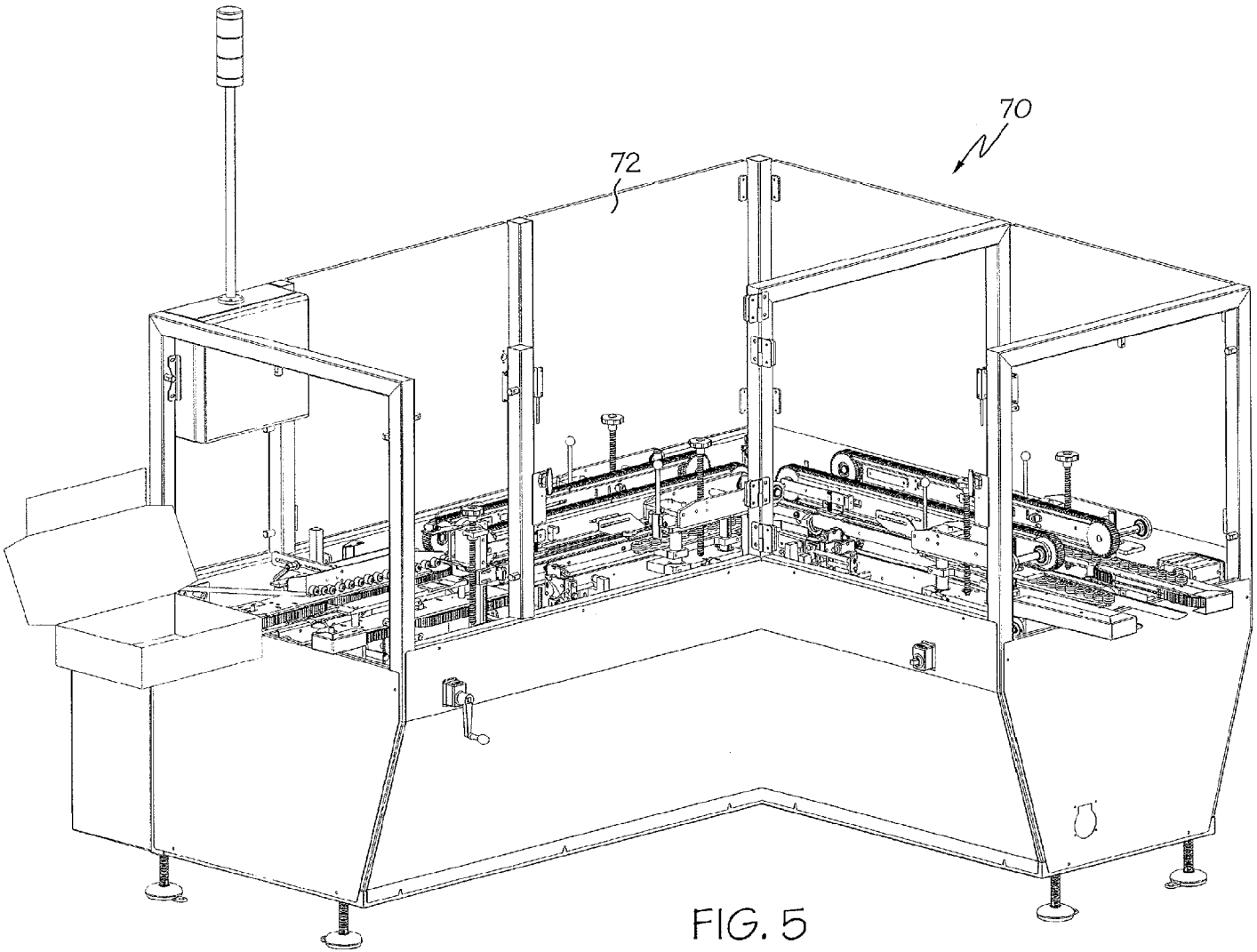
FIG. 5 is a front perspective view of an embodiment of a carton assembly machine incorporating an embodiment of the invention.
Figure 6:
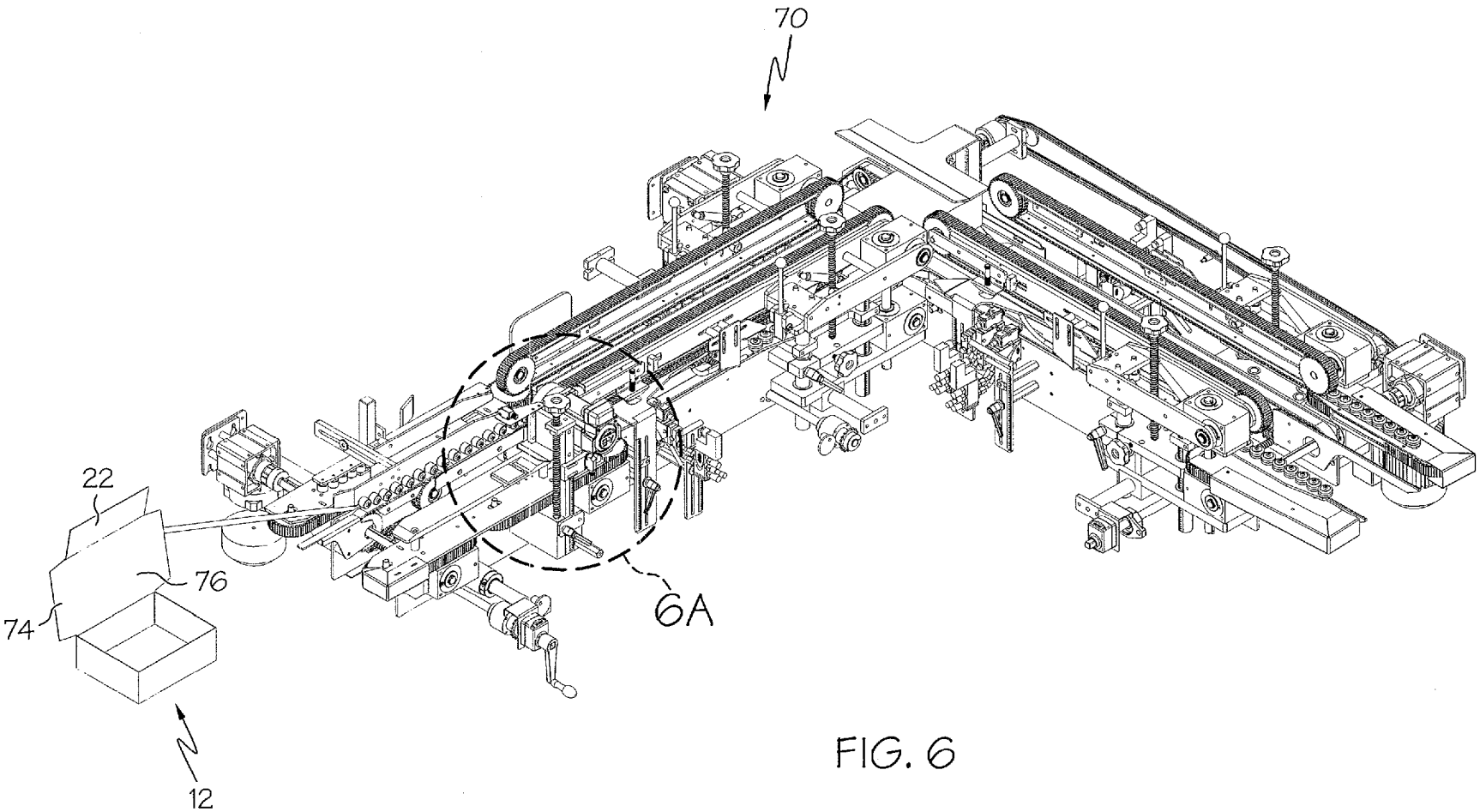
FIG. 6 is a front perspective view of an embodiment of the carton assembly machine of FIG. 5 with the safety enclosure removed, incorporating an embodiment of the invention.
Figure 6A:
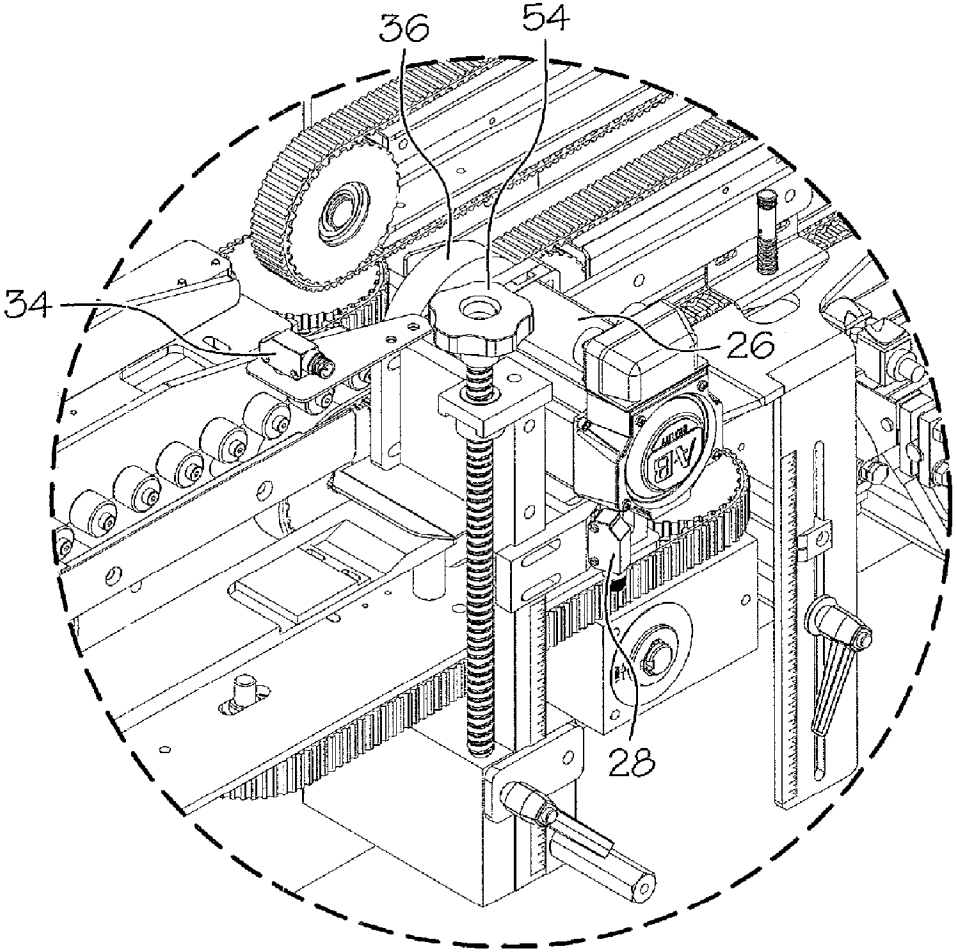
FIG. 6A is an enlarged view of a portion of FIG. 6.

FIG. 5 depicts an embodiment of a packaging assembly machine 70 with at least some safety panels 72 attached, as the machine would exist in a manufacturing environment. FIG. 6 depicts an embodiment of the packaging assembly machine 70 of FIG. 5, with the safety cover removed. The carton 12 in FIG. 6 is shown as a tri-seal carton having a tuck flap 22 and two side flaps 74, 76. FIG. 6A is an enlarged view of a portion of FIG. 6 showing the servo system in greater detail.

In addition to the apparatus described above, some embodiments of the invention are directed towards a method for real-time flap adjustment during carton assembly. The method includes providing a carton base sensor having a first output, a tuck flap sensor having a second output, and a servo system having at least one input, a servo motor, and a controller. The method further includes providing a carton having a carton base and a tuck flap.

As the carton moves along a conveyor belt, for example, the method comprises detecting the position of the leading edge of the tuck flap and the position of the rear edge of the carton base. From the outputs of the sensors, the method further comprises determining a distance between the leading edge of the tuck flap and the rear edge of the carton base. This distance determines whether correction is required, and if so, at which speed the correction wheel must rotate in order to align the top with the base. If the distance is greater than a predetermined value, the correction wheel must turn in at a first speed. If the distance is less than the predetermined value, the correction wheel must turn at a second speed.

The method further comprises engaging the tuck flap between the correction wheel and the nip roller. A person of ordinary skill in the art will recognize that engaging the tuck flap can occur, for example, prior to determining the direction in which the correction wheel should turn to correct alignment.

Once the tuck flap has been gripped between the correction wheel and the nip roller, the method further comprises rotating the flap correction wheel. The wheel is turned at a first speed if the calculated distance is greater than the predetermined value for correct alignment. The wheel is turned at a second speed if the calculated distance is less than the predetermined value for correct alignment. As the wheel is turned, the method comprises moving the tuck flap into relative alignment with the carton base.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

This completes the description of the preferred and alternate embodiments of the invention. Those skilled in the art may recognize other equivalents to the specific embodiment described herein which equivalents are intended to be encompassed by the claims attached hereto.

The invention claimed is:

1. A packaging system comprising:

a conveyor belt for conveying a carton; and a servo system comprising:

a servo motor;

a correction wheel engaged to the servo motor; and a controller for controlling the servo motor, the controller comprising a memory device, the controller configured to:

determine a distance between a leading edge of a tuck flap of the carton and a rear edge of a base of the carton;

compare the determined distance to a predetermined value stored in the memory device;

determine whether an adjustment of the tuck flap is required based on the comparison; and control the servo motor to rotate the correction wheel at a speed different from a speed of the conveyor belt if adjustment of the tuck flap is determined to be required.

2. The system of claim 1, further comprising:

a carton base sensor for detecting a position of the rear edge of the base of the carton; and a tuck flap sensor for detecting a position of the leading edge of the tuck flap of the carton, wherein the servo system is configured to record the position of the tuck flap and the position of the carton base.

3. The system of claim 2, wherein each of the carton base sensor and the tuck flap sensor are optical sensors.

4. The system of claim 3, wherein the carton base sensor has a first field of vision that is directed in a horizontal direction, and wherein the tuck flap sensor has a second field of vision that is directed in a downward direction.

5. The system of claim 2, wherein the detected position of the rear edge of the base of the carton and the detected position of the leading edge of the tuck flap of the carton are recorded by the servo system.

6. The system of claim 5, wherein the detected position of the rear edge of the base of the carton and the detected position of the leading edge of the tuck flap of the carton are recorded in the controller of the servo system.

7. The system of claim 1, further comprising:

a correction belt disposed about at least a portion of the correction wheel.

8. A method for real-time flap adjustment during carton assembly, the method comprising:

determining a distance between a leading edge of a tuck flap of a carton and a rear edge of a base of the carton;

comparing the determined distance to a predetermined value;

determining whether an adjustment of the tuck flap is required based on the comparison; and controlling a servo motor to rotate a correction wheel at a speed different from a speed of a conveyor belt if adjustment of the tuck flap is determined to be required.

9. The method of claim 8, further comprising:

detecting, via a carton base sensor, a position of the rear edge of the base of the carton; and detecting, via a tuck flap sensor, a position of the leading edge of the tuck flap of the carton, recording the detected position of the tuck flap and the detected position of the carton base.

10. The method of claim 9, wherein each of the carton base sensor and the tuck flap sensor are optical sensors.

11. The method of claim 10, wherein the carton base sensor has a first field of vision that is directed in a horizontal direction, and wherein the tuck flap sensor has a second field of vision that is directed in a downward direction.

12. The method of claim 9, further comprising:

recording, via a servo system, the detected position of the rear edge of the base of the carton and the detected position of the leading edge of the tuck flap of the carton.

13. The method of claim 12, wherein recording, via a servo system, the detected position of the rear edge of the base of the carton and the detected position of the leading edge of the tuck flap of the carton comprises:

recording the detected position of the rear edge of the base of the carton and the detected position of the leading edge of the tuck flap of the carton in the controller of the servo system.

14. A packaging system comprising:

means for conveying a carton; and a servo system comprising means for determining a distance between a leading edge of a tuck flap of a carton and a rear edge of a base of the carton;

means for comparing the determined distance to a predetermined value;

means for determining whether an adjustment of the tuck flap is required based on the comparison; and means for controlling a servo motor to rotate a correction wheel at a speed different from a speed of a conveyor belt if adjustment of the tuck flap is determined to be required.

* * * * *